US008610628B2

(12) United States Patent
Chen et al.

(10) Patent No.: US 8,610,628 B2
(45) Date of Patent: Dec. 17, 2013

(54) WIDEBAND ANTENNA

(75) Inventors: Wei-Yu Chen, New Taipei (TW); Shih-Wei Hsieh, Taipei (TW)

(73) Assignee: Mediatek Inc., Hsin-Chu (TW)

( * ) Notice: Subject to any disclaimer, the term of this patent is extended or adjusted under 35 U.S.C. 154(b) by 224 days.

(21) Appl. No.: 13/290,406

(22) Filed: Nov. 7, 2011

(65) Prior Publication Data

US 2013/0113661 A1 May 9, 2013

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS 6,963,310 B2 * 11/2005 Horita et al. ..... 343/702
7,113,133 B2 * 9/2006 Chen et al. ..... 343/700 MS
7,136,022 B2 * 11/2006 Sato et al. ..... 343/702
7,183,980 B2 * 2/2007 Chang et al. ..... 343/700 MS
7,352,326 B2 * 4/2008 Korva et al. ..... 343/700 MS
7,659,853 B2 2/2010 Chen et al.
7,825,863 B2 11/2010 Martiskainen et al.
2009/0153429 A1 6/2009 Su et al.
2010/0060528 A1 3/2010 Chiu et al.
2010/0328182 A1 12/2010 Wong et al.
2011/0095949 A1 * 4/2011 Wong et al. ..... 343/702
2011/0102283 A1 5/2011 Chang et al.
2011/0156958 A1 6/2011 Wong et al.
2012/0032862 A1 * 2/2012 Ying ..... 343/749

FOREIGN PATENT DOCUMENTS

EP 2 117 073 11/2009
EP 2 169 763 3/2010

* cited by examiner

*Primary Examiner* — Tan Ho
(74) *Attorney, Agent, or Firm* — McClure, Qualey & Rodack, LLP

(57) ABSTRACT

A wideband antenna includes: a substrate, having a first surface and a second surface; a ground plane, disposed on the second surface; an exciting element, disposed on the first surface, and having a feed point coupled to a signal source; a connection element, disposed on the first surface, and coupled to the ground plane; a first branch, disposed on the first surface, and coupled to the connection element; a second branch, disposed on the first surface, and coupled to the connection element; and a coupling element, disposed on the first surface, and coupled to the connection element.

20 Claims, 7 Drawing Sheets

WIDEBAND ANTENNA

BACKGROUND OF THE INVENTION

1. Field of the Invention

The disclosure generally relates to a wideband antenna, and more particularly, relates to a wideband antenna covering 5 frequency bands, GSM (Global System for Mobile Communications) 850/900/1800/1900 and UMTS (Universal Mobile Telecommunications System).

2. Description of the Related Art

Nowadays, wireless networks are operated according to a wide variety of communication standards and/or in a wide range of frequency bands. In order to accommodate multiple frequency bands and/or multiple communication standards, many mobile communication devices include a wideband antenna that covers multiple frequency bands or include a different antenna for each frequency band. As manufacturers continue to design smaller mobile communication devices, the inclusion of multiple antennas in a mobile communication device has become increasingly impractical. Furthermore, while wideband antennas often cover multiple frequency bands, they typically do not cover all desired frequency bands.

BRIEF SUMMARY OF THE INVENTION

In one exemplary embodiment, the disclosure is directed to a wideband antenna including: a substrate, having a first surface and a second surface; a ground plane, disposed on the second surface; an exciting element, disposed on the first surface, and having a feed point coupled to a signal source; a connection element, disposed on the first surface, and coupled to the ground plane; a first branch, disposed on the first surface, and coupled to the connection element; a second branch, disposed on the first surface, and coupled to the connection element; and a coupling element, disposed on the first surface, and coupled to the connection element, wherein a first distance between the coupling element and the second branch is smaller than 5 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
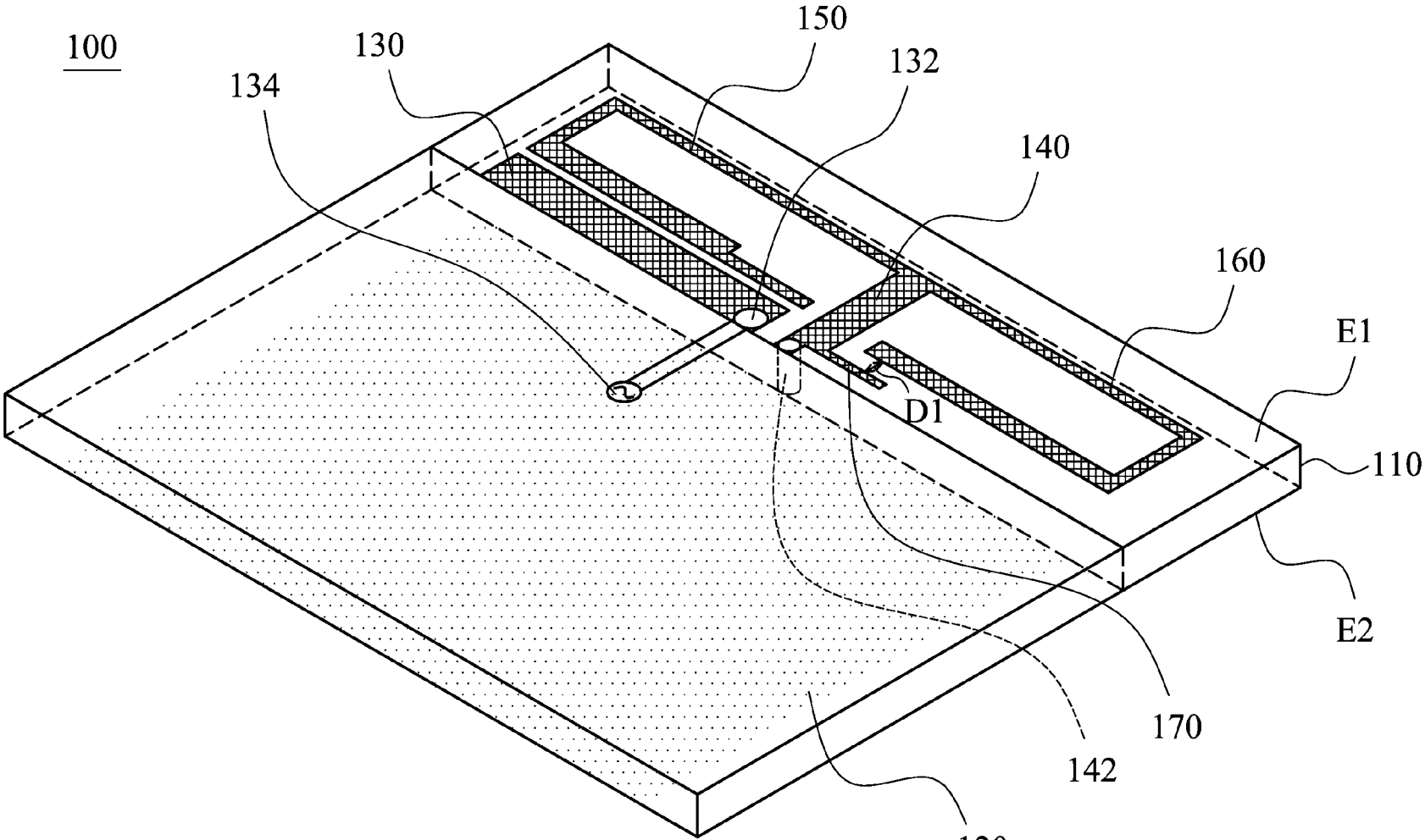
FIG. 1A is a pictorial drawing for illustrating a wideband antenna according to an embodiment of the invention.

FIG. 1A is a pictorial drawing for illustrating a wideband antenna 100 according to an embodiment of the invention.

Figure 1B:
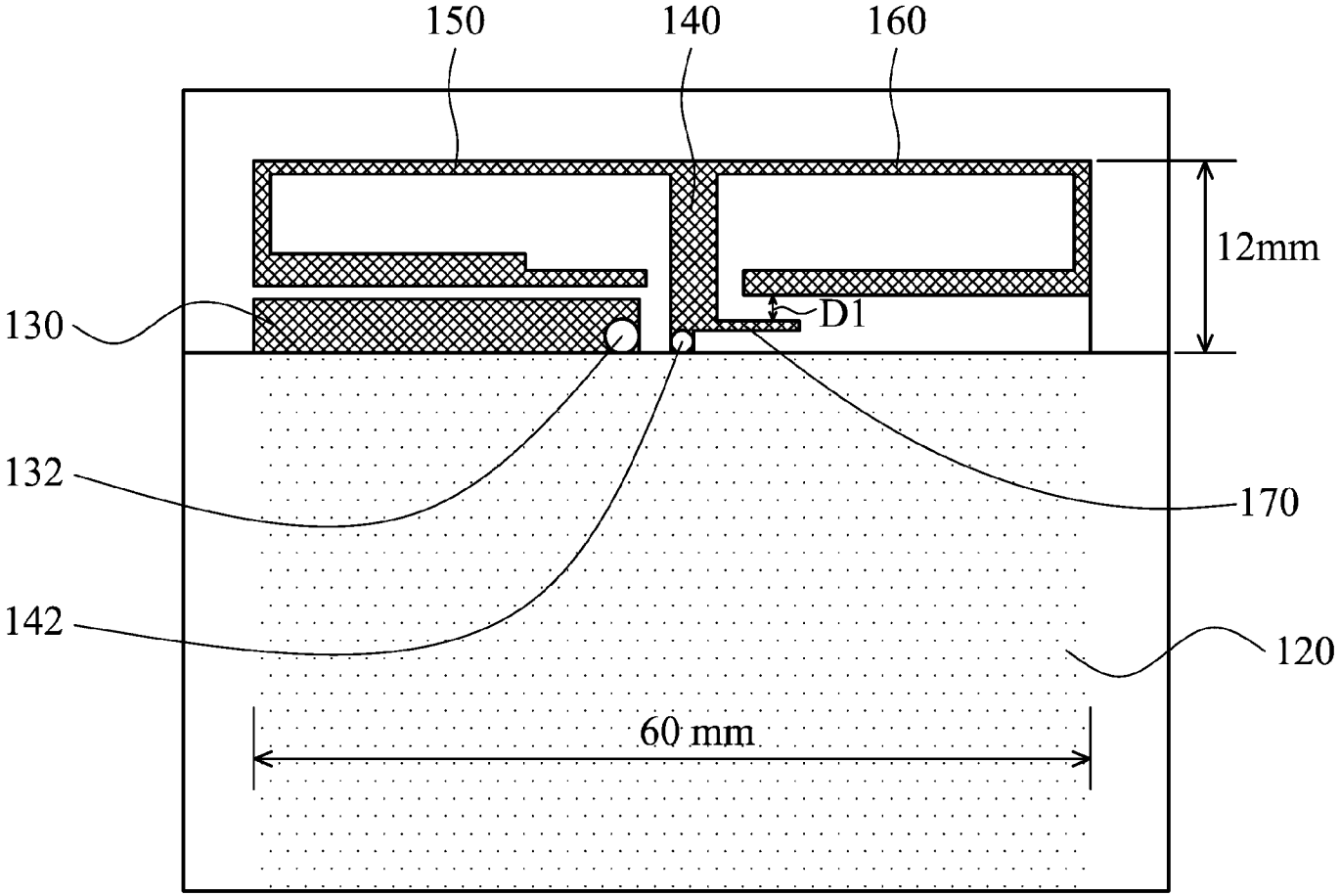
FIG. 1B is a vertical view drawing for illustrating the wideband antenna according to the embodiment of the invention.

FIG. 1B is a vertical view drawing for illustrating the wideband antenna 100 according to the embodiment of the invention. As shown in FIGS. 1A and 1B, the wideband antenna 100 comprises: a substrate 110, a ground plane 120 (the dotted region), an exciting element 130, a connection element 140, a first branch 150, a second branch 160, and a coupling element 170. The substrate 110 has a first surface E1 and a second surface E2, which is opposite to the first surface E1. The ground plane 120 is disposed on the second surface E2. The exciting element 130 is disposed on the first surface E1, and has a feed point 132, which is electrically coupled to a signal source 134, so as to receive input signals. It is noted that although disposed on the right end of the exciting element 130 as shown in FIGS. 1A and 1B, the feed point 132 may be disposed on the other end, the left end, of the exciting element 130. The connection element 140 is disposed on the first surface E1, and electrically coupled to the ground plane 120 through a metal line 142 (or a via 142). The first branch 150 is disposed on the first surface E1, and electrically coupled to the connection element 140. The second branch 160 is disposed on the first surface E1, and electrically coupled to the connection element 140. The coupling element 170 is disposed on the first surface E1, and electrically coupled to the connection element 140, wherein a first distance D1 between the coupling element 170 and the second branch 160 is smaller than 5 mm. The ground plane 120, the exciting element 130, the connection element 140, the first branch 150, the second branch 160, and the coupling element 170 may be all made of metal, e.g., silver or copper.

In an embodiment of the invention, the exciting element 130 is substantially straight; the connection element 140 is substantially straight; the first branch 150 is substantially U-shaped; and the second branch 160 is substantially U-shaped. With respect to sizes, the substrate 110 has a dielectric constant equal to 4.3 (FR4) and is 1 mm in thickness; the ground plane 120 is approximately 60 mm in width; the exciting element 130 is approximately 27 mm in length; the connection element 140 is approximately 12 mm in length and 3 mm in width; the first branch 150 is approximately 64.5 mm in length; the second branch 160 is approximately 57 mm in length; the coupling element 170 is approximately 7 mm in length; the first distance D1 between the second branch 160 and the coupling element 170 is substantially from 1.2 mm to 3 mm. It is noted that all the element sizes may change in response to different dielectric constants or desired frequency bands.

Figure 2:
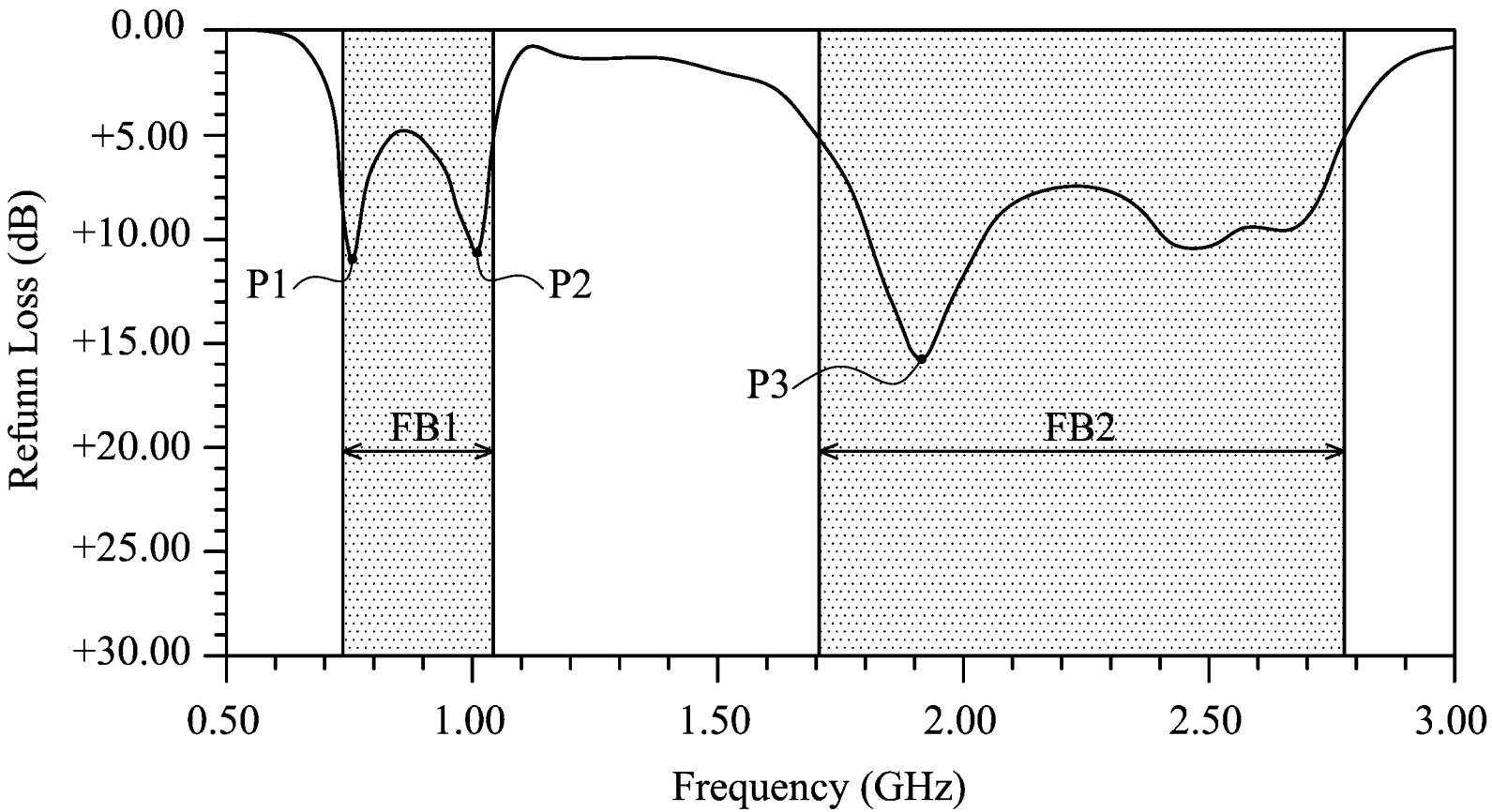
FIG. 2 is a diagram for illustrating return loss of the wideband antenna according to an embodiment of the invention.

FIG. 2 is a diagram for illustrating return loss of the wideband antenna 100 according to an embodiment of the invention. The vertical axis represents return loss (unit: dB), and the horizontal axis represents frequency (unit: GHz). The wideband antenna 100 may cover a first frequency band FB1 and a second frequency band FB2 in response to the criterion set as 5 dB. The exciting element 130, the connection element 140, the first branch 150, the second branch 160, and the coupling element 170 are excited so as to form the first frequency band FB1. More particularly, a frequency point P1 within the first frequency band FB1 is generated by exciting the exciting element 130, the connection element 140 and the first branch 150; and a frequency point P2 within the first frequency band FB1 is generated by exciting the exciting element 130, the connection element 140, the first branch 150, the second branch 160 and the coupling element 170. The exciting element 130 is excited so as to form the second frequency band FB2, and more particularly, a frequency point P3 within the second frequency band FB2 is generated by exciting the exciting element 130. In a preferred embodiment, the first frequency band FB1 is approximately from 730 MHz to 1040 MHz, and the second frequency band FB2 is approximately from 1730 MHz to 2760 MHz.

Figure 3:
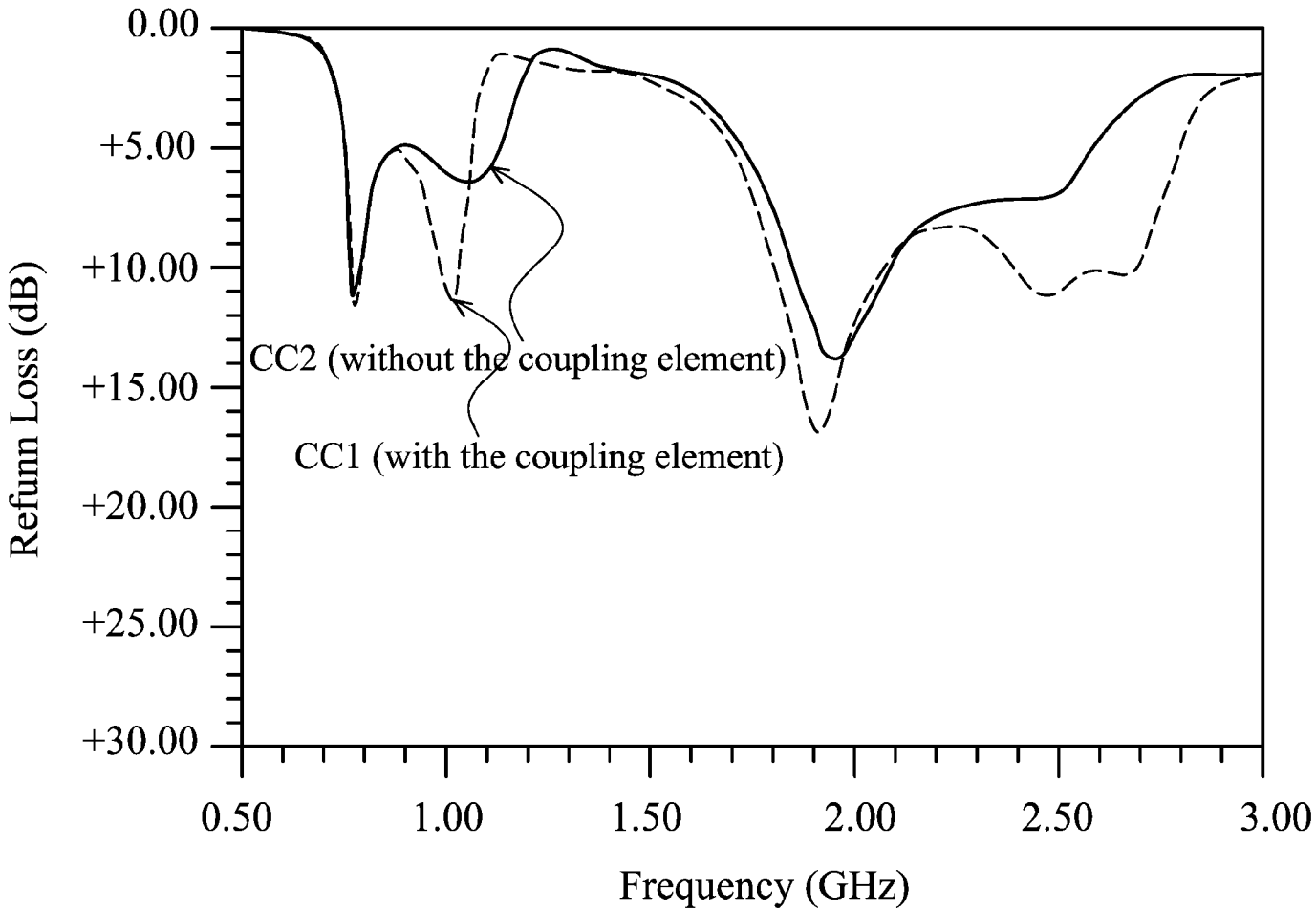
FIG. 3 is a diagram for illustrating return loss of the wideband antenna without the coupling element.

It is noted that the coupling element 170 is utilized for mutual coupling between the connection element 140 and the second branch 160. A past experiment found that removing the coupling element 170 from the wideband antenna causes missing of the frequency point P2 in the diagram of return loss. FIG. 3 is a diagram for illustrating return loss of the wideband antenna 100 without the coupling element 170. There are two curves, CC1 and CC2 in FIG. 3. The curve CC1 represents the return loss of the wideband antenna 100 with the coupling element 170. On the contrary, the curve CC2 represents the return loss of the wideband antenna 100 without the coupling element 170. The curve CC2 does not have the frequency point P2, so the bandwidth is limited.

Figure 4A:
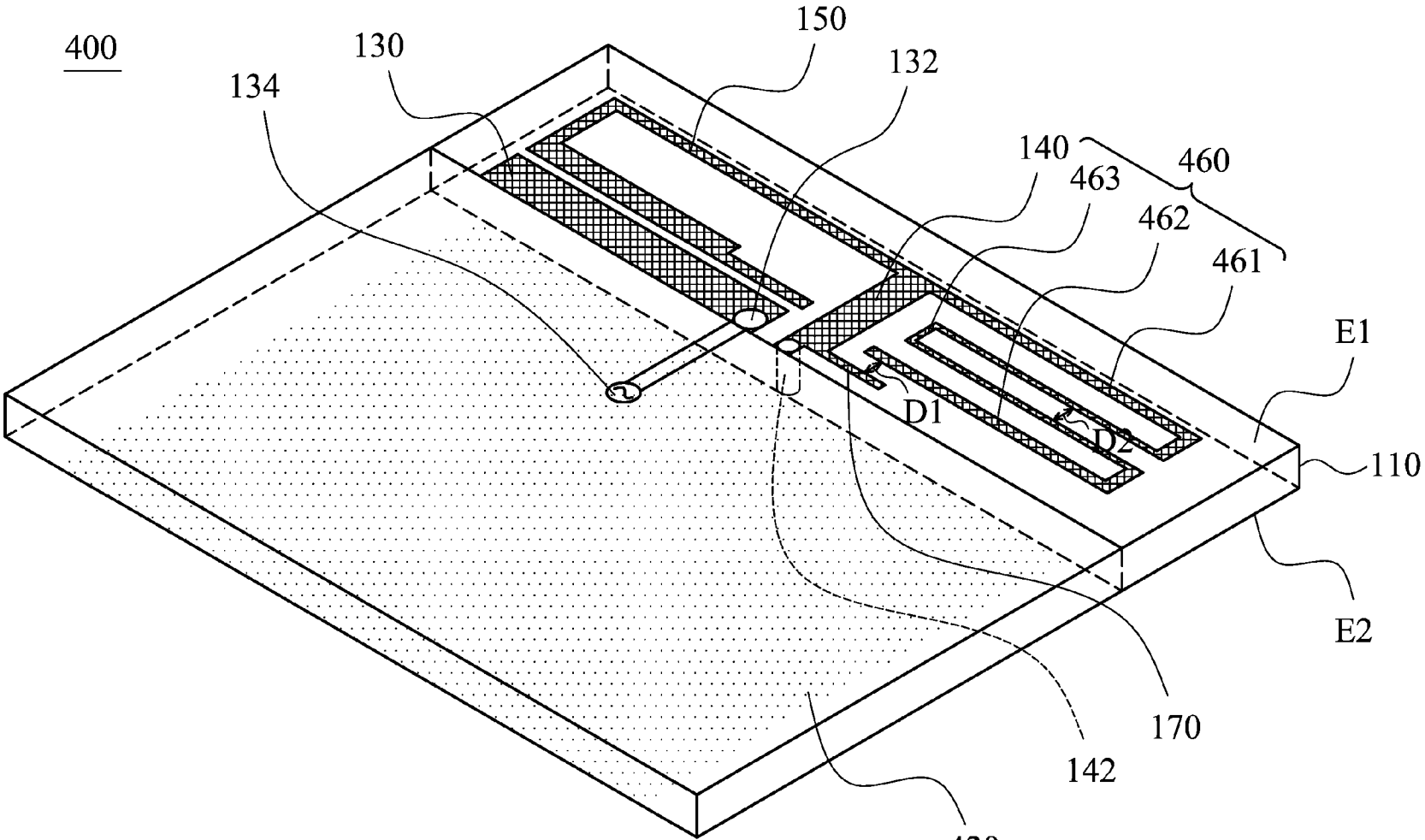
FIG. 4A is a pictorial drawing for illustrating a wideband antenna according to another embodiment of the invention.
Figure 4B:
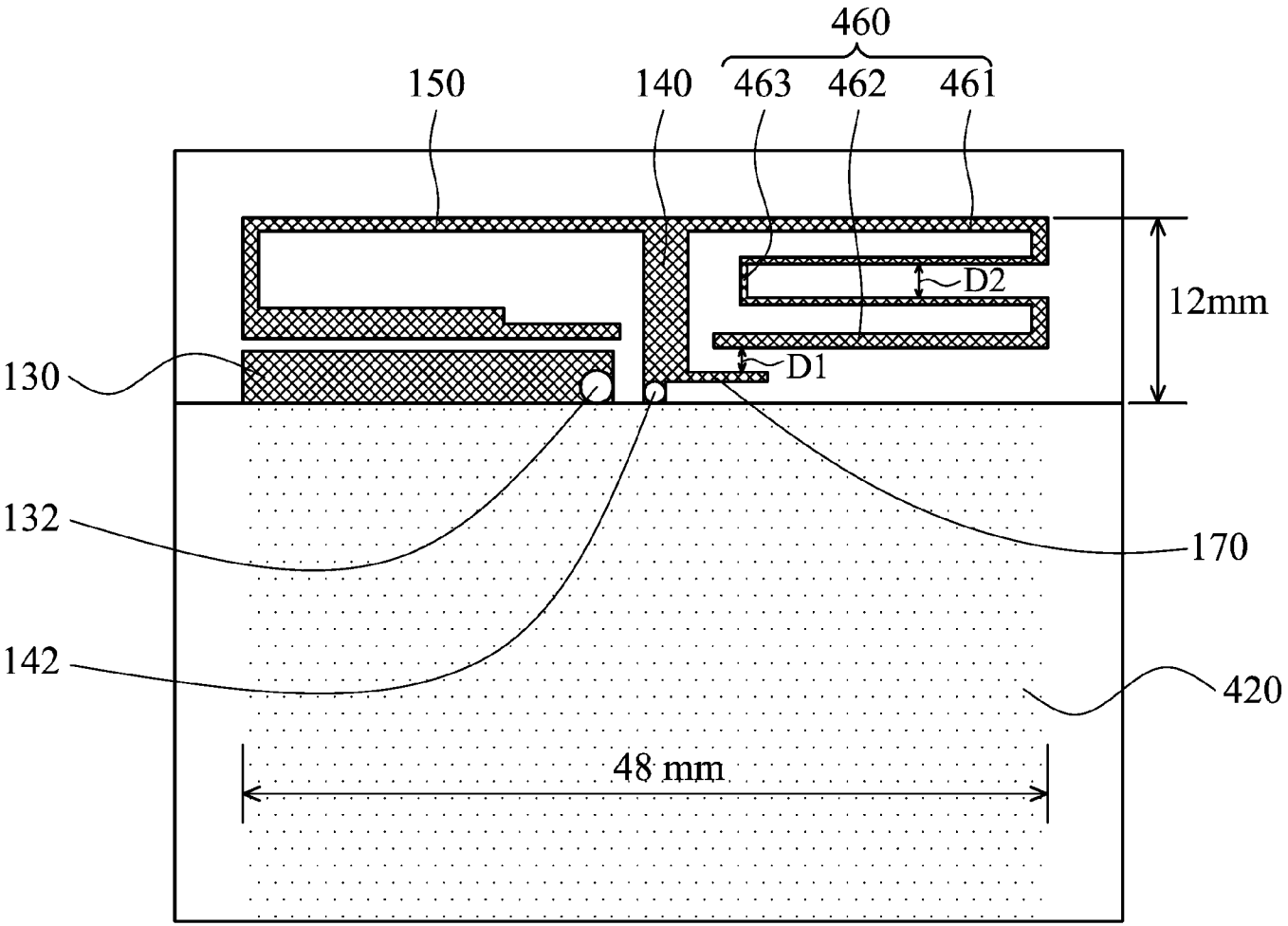
FIG. 4B is a vertical view drawing for illustrating the wideband antenna according to the embodiment of the invention.

FIG. 4A is a pictorial drawing for illustrating a wideband antenna 400 according to another embodiment of the invention. FIG. 4B is a vertical view drawing for illustrating the wideband antenna 400 according to the embodiment of the invention. The wideband antenna 400 is similar to the wideband antenna 100 as shown in FIGS. 1A and 1B; however, the difference between them is that the second branch 160 is replaced with another second branch 460, and the ground plane 120 is replaced with another ground plane 420. As shown in FIGS. 4A and 4B, the second branch 460, coupled to the connection element 140, comprises a first U-shaped portion 461, a second U-shaped portion 462, and a connection piece 463. The second U-shaped portion 462 is electrically coupled to the first U-shaped portion 461 through the connection piece 463. By meandering second branch, the wideband antenna 400 may occupy less area than the wideband antenna 100; therefore, the width of the ground plane 420 can be reduced.

In another embodiment, the substrate 110 has a dielectric constant equal to 4.3 (FR4) and is 1 mm in thickness; the ground plane 420 is approximately 48 mm in width; the exciting element 130 is 26 mm in length; the connection element 140 is approximately 12 mm in length and 4.5 mm in width; the first branch 150 is 62.5 mm in length; the second branch 460 is 63.5 mm in length; the coupling element 170 is 7 mm in length; a first distance D1 between the second branch 460 and the coupling element 170 is substantially from 12 mm to 3 mm; a second distance D2 between the first U-shaped portion 461 and the second U-shaped portion 462 is greater than 0.5 mm. It is noted that all the element sizes may change in response to different dielectric constants or desired frequency bands.

Figure 5:
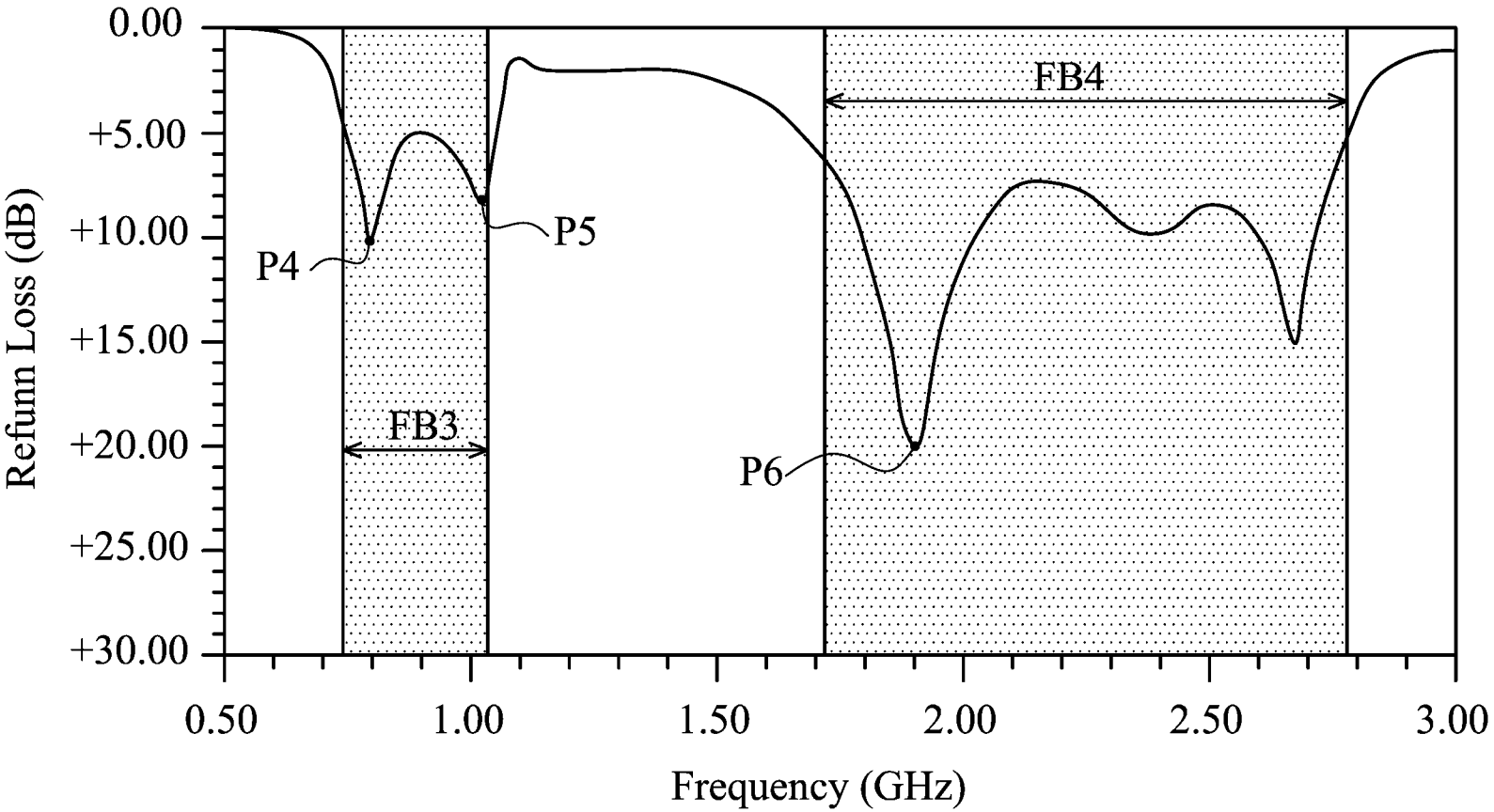
FIG. 5 is a diagram for illustrating return loss of the wideband antenna according to an embodiment of the invention.

FIG. 5 is a diagram for illustrating return loss of the wideband antenna 400 according to an embodiment of the invention. The vertical axis represents return loss (unit: dB), and the horizontal axis represents frequency (unit: GHz). The wideband antenna 400 may cover a third frequency band FB3 and a fourth frequency band FB4 in response to the criterion set as 5 dB. The exciting element 130, the connection element 140, the first branch 150, the second branch 460, and the coupling element 170 are excited so as to form the third frequency band FB3. More particularly, a frequency point P4 within the third frequency band FB3 is generated by exciting the exciting element 130, the connection element 140 and the first branch 150; and a frequency point P5 within the third frequency band FB3 is generated by exciting the exciting element 130, the connection element 140, the first branch 150, the second branch 460 and the coupling element 170. The exciting element 130 is excited so as to form the fourth frequency band FB4, and more particularly, a frequency point P6 within the fourth frequency band FB4 is generated by exciting the exciting element 130. In a preferred embodiment, the third frequency band FB3 is approximately from 750 MHz to 1040 MHz, and the fourth frequency band FB4 is approximately from 1740 MHz to 2750 MHz.

Table I illustrates comparison between the wideband antennas 100 and 400.

TABLE I the comparison between the wideband antennas 100 and 400

| Wideband antenna | Start frequency (MHz) | End frequency (MHz) | Bandwidth (MHz) | Bandwidth (%) |
|---|---|---|---|---|
| 100 (FB1) | 730 | 1040 | 310 | 35.03 |
| 100 (FB2) | 1730 | 2760 | 1030 | 45.88 |
| 400 (FB3) | 750 | 1040 | 290 | 32.40 |
| 400 (FB4) | 1740 | 2750 | 1010 | 44.99 |

As shown in Table I, it is clear that wideband antennas 100 and 400 have similar performance. Both of them cover 5 frequency bands, GSM (Global System for Mobile Communications) 850/900/1800/1900 and UMTS (Universal Mobile Telecommunications System) bands. However, the wideband antenna 400 has the small ground plane 420, which is reduced from 60 mm to 48 mm in width, so that the antenna area of the wideband antenna 400 is reduced by 20%.

The invention provides the wideband antennas for operating in 5 frequency bands, GSM 850/900/1800/1900 and UMTS. Furthermore, the antenna area can be reduced to 48 mm by 12 mm, which is a very small area. These wideband antennas can be applied to a variety of mobile devices, for example, cellular phones, tablet PC (Tablet Personal Computer), or notebooks.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A wideband antenna, comprising:

a substrate, having a first surface and a second surface;

a ground plane, disposed on the second surface;

an exciting element, disposed on the first surface, and having a feed point coupled to a signal source;

a connection element, disposed on the first surface, and coupled to the ground plane;

a first branch, disposed on the first surface, and coupled to the connection element;

a second branch, disposed on the first surface, and coupled to the connection element; and a coupling element, disposed on the first surface, and coupled to the connection element, wherein a first distance between the coupling element and the second branch is smaller than 5 mm.

2. The wideband antenna as claimed in claim 1, wherein the exciting element is substantially straight.

3. The wideband antenna as claimed in claim 1, wherein the connection element is substantially straight.

4. The wideband antenna as claimed in claim 1, wherein the first branch is substantially U-shaped.

5. The wideband antenna as claimed in claim 1, wherein the first distance is substantially from 1.2 mm to 3 mm.

6. The wideband antenna as claimed in claim 1, wherein the second branch is substantially U-shaped.

7. The wideband antenna as claimed in claim 6, wherein the exciting element, the connection element, the first branch, the second branch, and the coupling element are excited so as to form a first frequency band.

8. The wideband antenna as claimed in claim 7, wherein the first frequency band is approximately from 730 MHz to 1040 MHz.

9. The wideband antenna as claimed in claim 6, wherein the exciting element is excited so as to form a second frequency band.

10. The wideband antenna as claimed in claim 9, wherein the second frequency band is approximately from 1730 MHz to 2760 MHz.

11. The wideband antenna as claimed in claim 6, wherein the ground plane is approximately 60 mm in width.

12. The wideband antenna as claimed in claim 1, wherein the second branch comprises:

a first U-shaped portion;

a connection piece; and a second U-shaped portion, coupled to the first U-shaped portion through the connection piece.

13. The wideband antenna as claimed in claim 12, wherein a second distance between the first and second U-shaped portions is greater than 0.5 mm.

14. The wideband antenna as claimed in claim 12, wherein the exciting element, the connection element, the first branch, the second branch, and the coupling element are excited so as to form a third frequency band.

15. The wideband antenna as claimed in claim 14, wherein the third frequency band is approximately from 750 MHz to 1040 MHz.

16. The wideband antenna as claimed in claim 12, wherein the exciting element is excited so as to form a fourth frequency band.

17. The wideband antenna as claimed in claim 16, wherein the fourth frequency band is approximately from 1740 MHz to 2750 MHz.

18. The wideband antenna as claimed in claim 12, wherein the ground plane is approximately 48 mm in width.

19. The wideband antenna as claimed in claim 1, wherein the connection element is approximately 12 mm in length.

20. The wideband antenna as claimed in claim 1, wherein substrate has a dielectric constant equal to 4.3 and is 1 mm in thickness.

* * * * *